United States Patent [19]

Larson

[11] Patent Number: 4,909,231

[45] Date of Patent: Mar. 20, 1990

[54] DUAL ANCHOR CABLE SEPARATOR FOR COMPOUND BOWS

[75] Inventor: Marlow W. Larson, Ogden, Utah

[73] Assignee: Browning, Morgan, Utah

[21] Appl. No.: 274,475

[22] Filed: Nov. 21, 1988

[51] Int. Cl.[4] ..... F41B 5/00

[52] U.S. Cl. ..... 124/23 R; 124/DIG. 1; 124/90; 124/24 R

[58] Field of Search ..... 124/23 R, 24 R, 90, 124/DIG. 1

[56] References Cited

U.S. PATENT DOCUMENTS

| | | | |
|---|---|---|---|
| 3,993,039 | 11/1976 | Groves et al. | 124/90 |
| 4,064,862 | 12/1977 | Groner | 124/DIG. 1 |
| 4,300,521 | 11/1981 | Schmitt . | |
| 4,333,443 | 6/1982 | Roelle | 124/DIG. 1 |
| 4,336,786 | 6/1982 | Mannon et al. | 124/DIG. 1 |
| 4,337,749 | 7/1982 | Barna | 124/DIG. 1 |
| 4,365,611 | 12/1982 | Nishioka . | |
| 4,372,285 | 2/1983 | Simonds et al. | 124/DIG. 1 |
| 4,440,142 | 4/1984 | Simonds | 124/DIG. 1 |
| 4,478,203 | 10/1984 | Hayes . | |
| 4,524,750 | 6/1985 | Darlington . | |
| 4,546,754 | 11/1981 | Schmitt . | |
| 4,561,413 | 12/1985 | Jennings . | |
| 4,770,154 | 9/1988 | Cook et al. | 124/DIG. 1 |
| 4,781,167 | 11/1988 | Martin | 124/DIG. 1 |

*Primary Examiner*—Randolph A. Reese
*Assistant Examiner*—Carol I. Bordas
*Attorney, Agent, or Firm*—Trask, Britt & Rossa

[57] ABSTRACT

An anchoring system for connecting the tension cables of a compound bow to the axle of an eccentric includes a body member fixed to the cable and a traveling member interposed between the body member and the axle and in contact with a loop of cable between the body member and the axle available to adjust the effective length of the cable.

23 Claims, 4 Drawing Sheets

DUAL ANCHOR CABLE SEPARATOR FOR COMPOUND BOWS

BACKGROUND OF THE INVENTION

Field 1.

This invention relates to compound bows. It is specifically directed to an improved cable attachment assembly for attaching cables to the opposite limb tips of a bow.

State of the Art: 2.

Compound bows conventionally include a rigging arrangement utilizing eccentrics mounted to pivot on axles at the tips of opposite limbs extending from the respective opposite ends of a handle. The eccentrics are interconnected by. cables. Two substantially identical cables extend from attachment to opposite ends of a bowstring from which each cable then connects to an eccentric at one limb tip. Each cable then extends from its associated eccentric to connect to an attachment device carried by the opposite limb tip.

Various methods and devices have been utilized for attaching the tension end (the end opposite the end connected to the bowstring) of a cable to a limb. Early versions of the compound bow simply attached the anchored end of a cable to the axle of the eccentric carried by that limb. Subsequent versions of the compound bow utilized various arrangements, typically called yokes or yoked assemblies. These yoke assemblies function more evenly to distribute the forces on opposite sides of the eccentric, thereby greatly to reduce the twisting forces prevalent in earlier arrangements. Typical of such yoke assemblies is that disclosed by U.S. Pat. No. 4,300,521 which comprises a circular disk with a circumferential groove and a central aperture. A length of cable extends around the groove of the disk with its opposite ends straddling the centric and connecting to opposite ends of the eccentric axle. The attachment end of a cable extending from the eccentric mounted at the opposite limb tip extends through the central aperture of the disk and is thereby attached. Yoke anchors of this type adequately connect the cables to the bow limbs but are so located and arranged that either the bowstring or a portion of the opposite cable (the segment extending from attachment to the proximate eccentric) may make contact with the yoke assembly when an arrow is launched.

Recently issued U.S. Pat. No. 4,781,167, the disclosure of which is incorporated by reference herein, describes various yoke cable devices shown by previous U.S. Pat. Nos. 4,546,754; 4,440,142; 4,337,749; 4,333,443; the aforementoned 4,300,521 and 4,064,862. U.S. Pat. No. 4,781,167 recognizes the limitations of such previous yoke devices in connection with adjustments of the tension cables, and proposes an improved adjustment mechanism whereby a tension cable is connected to a separate yoke cable through a linkage fixture of adjustable length.

Other yoke cable arrangements are disclosed by U.S. Pat. Nos. 4,478,203; 4,561,413; and 4,365,611.

A characteristic common to prior art cable anchoring systems is the reliance upon a separate yoke cable or equivalent bracket device as a linkage between the axle and a tension cable. No practical system has heretofore evolved for attaching a cable directly to an axle while obtaining the force distribution benefits of a yoke assembly. Moreover, these devices have generally not avoided the problem of string or cable interference when an arrow is launched.

U.S. Pat. No. 4,524,750, which does not relate to a yoke assembly, suggests the avoidance o string contact by pulling the tension runs forward. The eccentric end of one tension cable is held near the anchored end of the other cable by means of a double sleeve fixture.

SUMMARY OF THE INVENTION

The present invention provides cable anchoring assembly which avoids the necessity of a separate yoke cable or comparable bracket device while still offering all of the benefits of such devices as embodied in the prior art. The invention may be embodied variously to hold the tension cables of a compound bow in non-infringing relationship with either the string or the cable anchoring mechanism. According to this invention each tension cable is anchored directly to the axle of an eccentric member. The effective lengths of the tension cables are individually adjustable to whatever degree is desired, rather than incrementally.

broadly, the invention usually includes a body member for retaining a pair of cable strands resulting from doubling the end portions of a cable back onto itself to form a looped end segment. This end segment is usually folded into loops which straddle an eccentric and connects to the axle on opposite sides of the eccentric. A traveling member engages some portion of the end segment to adjust the effective length of the cable. According to certain embodiments, the body member and the traveling member are associated in an assembly. In other embodiments, the traveling member is associated with the axle. In still other embodiments, the looped end segment connects on one side of the eccentric, preferably by means of a body member which also functions as a traveling member.

A cable retaining fixture is ideally associated with the body member to hold the tension cables together in the proximity of the eccentrics. The anchoring assembly is thereby held clear from the bowstrigg and stabilizes the cables during operation of the bow.

BRIEF DESCRIPTION OF THE DRAWINGS

In the drawings, which illustrate what is presently regarded as the best mode for carrying out the invention.

DESCRIPTION OF THE ILLUSTRATED EMBODIMENTS

Figure 1:
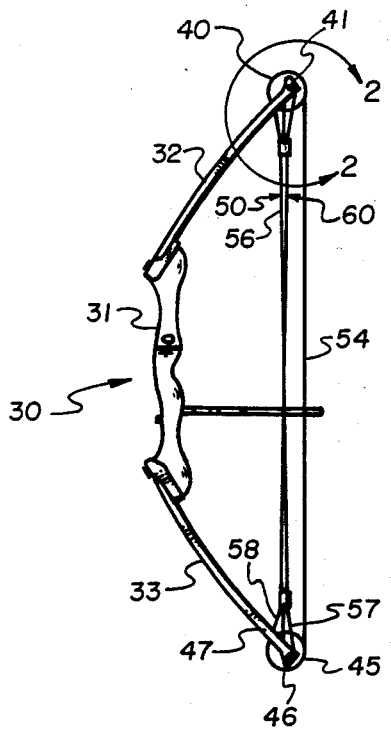
FIG. 1 is a view in side elevation illustrating a typical compound bow equipped with one embodiment of the invention.
Figure 2:
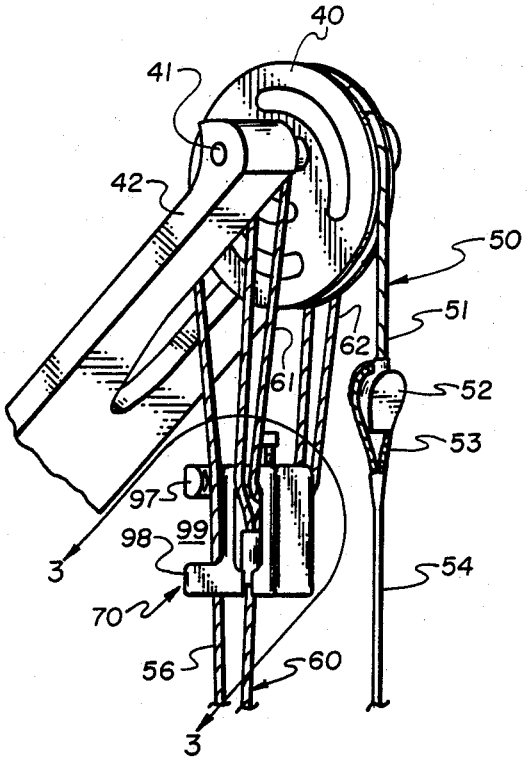
FIG. 2 is an enlarged view in perspective of the portion designated 2—2 in FIG. 1.

FIG. 1 illustrates a typical compound bow, designated generally 30, including a handle riser 31, a first (upper) limb 32, and a second (lower) limb 33. As best illustrated by FIG. 2, a first eccentric member 40 is mounted on a first axle 41 carried by a first limb tip 42. In like manner, a second eccentric 45 is mounted on a second axle 46 carried by a second limb tip 47 (FIG. 1).

Figure 6:
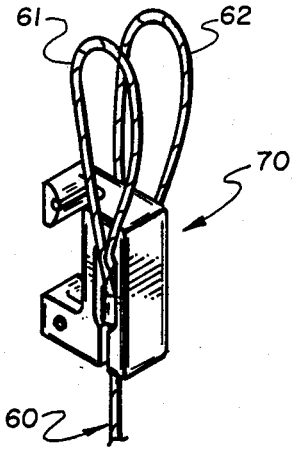
FIG. 6 is an illustration of the tension cable of FIG. 5 in assembled association with the assembly of FIG. 3.

A first cable, designated generally 50, is connected to the first eccentric member 40. A first portion 51 of the cable 50 carries a "tear drop" connector 52 which attaches as shown to a loop 53 at one end of a bowstring 54. A second portion 56 of the cale 50 extends from attachment to the eccentric 40 across the handle riser 31 towards the second eccentric 45, connecting to the second axle 46 by means of loops 57 and 58. In like fashion, a second cable, designated generally 60, extends from attachment to the second eccentric 45 to connect by means of a first loop 61 and a second loop 62 formed as best illustrated by FIG. 6, to the axle 41.

A preferred embodiment of the invention includes the assembly, designated generally 70, illustrated by FIGS. 2, 3, 4 and 6. The assembly 70 includes a body member 71 with a first, approximately longitudinally oriented (wit the bow 30 held as shown in FIG. 1 and 2), cable passageway 72 with an entry 73 and a second cable passageway 75 intersecting the first passageway 72 and having a first opening 76 (FIG. 3) and a second opening 77 (FIG. 4) remote from the entry 73. A traveling member 80 (FIG. 3) or 81 (FIG. 4) is mounted in movable relationship with respect to the body member 71. As illustrated, the traveling member 80, 81 is slidably mounted within the body member 71 and can be urged towards the entry 73 (hence, away from the axle 41 (FIG. 2)) by turning a bolt 84 into a threaded bore 85. Movement by the traveling member 80, 81 may be reversed by reversing the direction of travel of the bolt 84.

Figure 4:
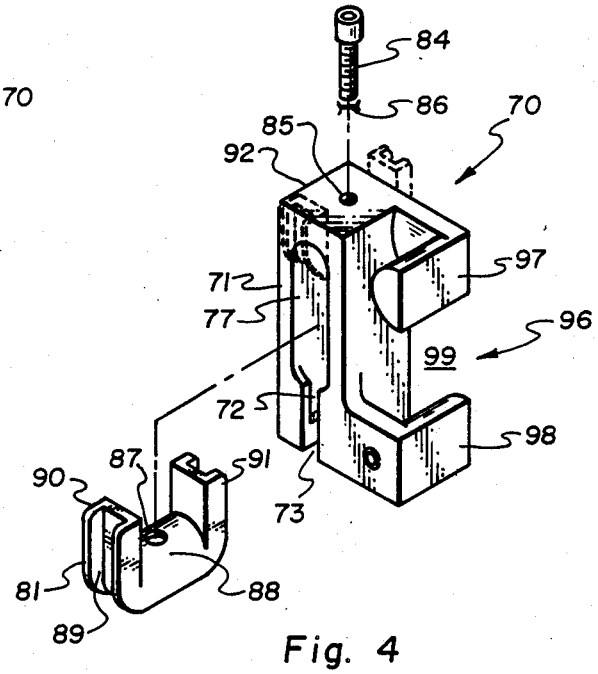
FIG. 4 is an exploded view of a slightly modified version of the assembly of FIG. 3, rotated approximately 180. around a vertical axis as compared to FIG. 3.

As may be seen from FIG. 4, the distal end 86 of the bolt 84 may be adapted for revolvable connection within a bore 87 in the base 88 of traveling member 81. The member 81 is also provided with a cable groove 89 to receive portions of the cable 60 passing through the second cable passageway 75 (see FIGS. 2 and 6). Arms 90 and 91, upstanding from the base 88 straddle the end 92 of the traveling member 81, lending stability to the assembly 70. The traveling member 80 is simpler in construction, but operates in approximately identical fashion.

Although the entry 73 is illustrated as a slot in longitudinal alignment with the first cable passageway 72, other configurations are within contemplation, e.g. a bore in alignment with the passageway 72. In any event, referring specifically to FIG. 2, the cable 60 is retained by the body member 71, and in accordance with certain preferred embodiments, the portion 56 of the cable 50 is retained by a fixture, designated generally 96 (FIG. 4) associated the body member 71. As shown by FIG. 2, the cable portion 56 is held by extensions 97, 98, being insertable through the slot 99. The fixture 96 holds the cables 50 and 60 together, thereby avoiding the nuisance associated from migration of those cables during operation of the bow.

Figure 7:
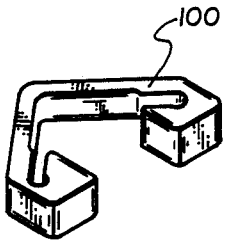
FIG. 7 is a view in perspective of a cable retainer forming a part of certain alterative embodiments of the invention.

FIG. 7 illustrates an alternative fixture 100 which is shown installed to hold cables 50 and 60 in a circumstance where a body member 101 similar to member 71, but without an associated cable retaining fixture 96, is used. The assembly illustrated by FIG. 8 may be regarded as the approximate equivalent in function and operation as the assembly illustrated by FIG. 2.

A notable achievement of the present invention is the provision of an anchoring system which applies forces venly to the axle 41 on both sides of eccentric 40 in the fashion of prior art yoke assemblies, but without the need for secondary cable (yoke) assemblies. The anchoring system, e.g. 70, of the . invention configurates the portion of a tension cable normally connected to a yoke device as a double loop 61, 62 adapted to connect directly to axle 41. The double loop 61, 62 is formed by folding an intermediate circular segment 10-.4of cable 60 (FIG. 5) formed by fixing the terminal end 105 with respect to an initial segment 106 o the second portion 107 of the cable 60. The circle of cable 50 formed is folded so that the loops 61, 62 can be placed over the axle 41 on opposite sides of the eccentric 40. A part 108 of the intermediate segment 104 passes through the second cable passageway 75. Many alternative arrangements are within contemplation whereby some part of this intermediate segment 104 contacts a traveling member (e.g. 80, 81) opposite the axle 41. FIGS. 9 through 24 illustrate certain such alternative arrangements.

Figure 3:
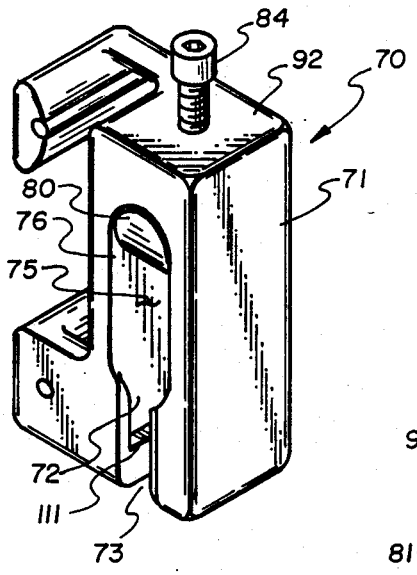
FIG. 3 is an enlarged view in perspective of a assembly designated 3—3 in FIG. 2.
Figure 5:
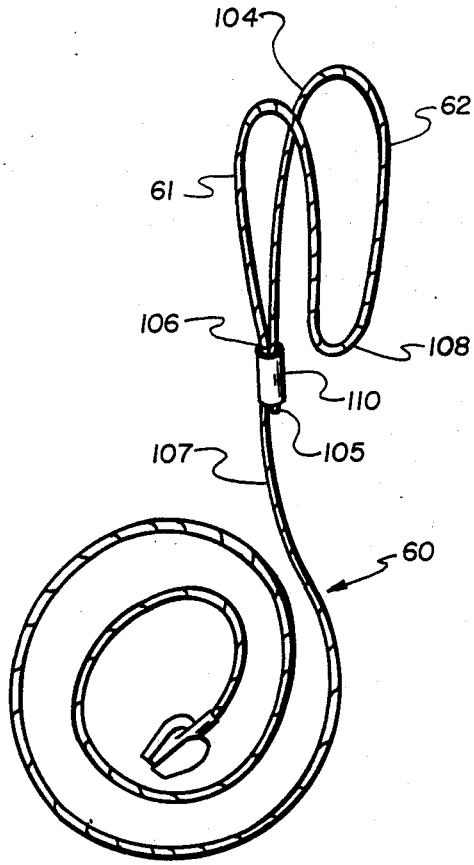
FIG. 5 is an illustration of a tension cable configurated for use with the assembly of FIG. 3.
Figure 8:
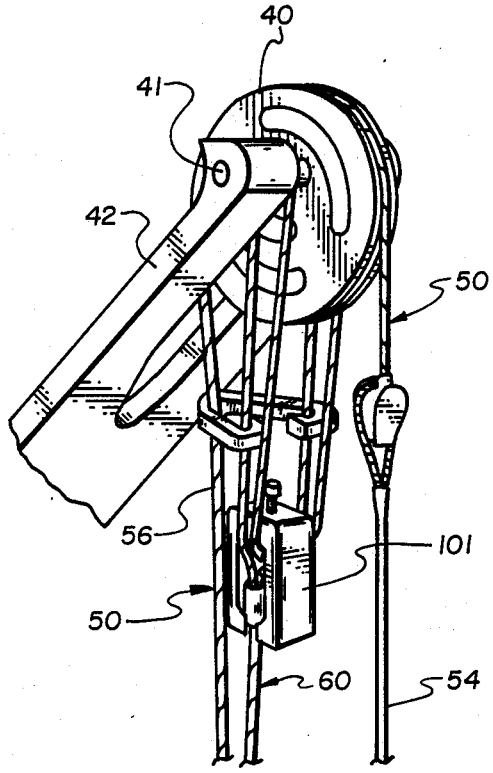
FIG. 8 is a view in perspective similar to FIG. 2 but illustrating an alternative embodiment of the invention including the cable retainer of FIG. 7.
Figure 9:
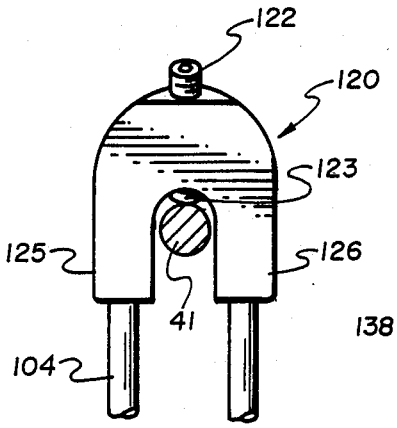
FIGS. 9, 10, 11 and 12 illustrate in front elevation, side elevation bottom plan and top plan views, respectively, an alternative embodiment of the invention.
Figure 13:
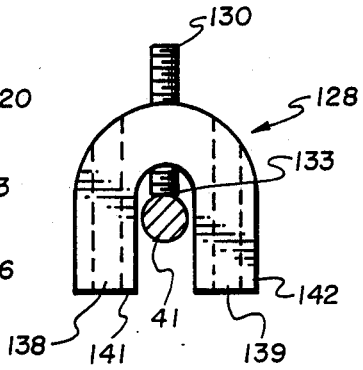
FIGS. 13, 14, 15 and 16 illustrate in front elevation, side elevation, bottom plan and top plainview, respectively, another alternative embodiment of the invention.
Figure 17:
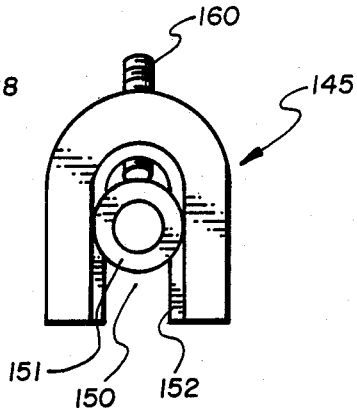
FIGS. 17, 18, 19 and 20 illustrate in front elevation, side elevation, bottom plan and top plan views, respectively, another alternative embodiment of the invention.

Referring to FIGS. 2, 3 and 6, the configuration of the second portion 107 of the cable 60 in accordance with the improved cable rigging of this invention may be achieved in various ways depending upon the structure of the assembly 70. The cable 60 may be pre-folded as illustrated by FIG. 5 and inserted in place as shown by FIG. 6 prior to assembly of the bow as shown by FIG. 1. The eccentric 40 may then be placed between the loops 61, 62 and the axle 41 slipped through the loops and eccentric as shown by FIGS. 2 and 8. In any event, however, the --second segment 107 will be configurated as though the end 105 has been fed or run through the entry 73 into the first passageway 72, then out the first opening 76 and over the axle 41 on one side of the eccentric 40, thence back through the first opening 76, the second passageway 75, out the second opening 77, over the axle 41 on the opposite side of the eccentric 40 and back through the second opening 77 for attachment relative to the initial segment 106. As shown, the end 105 is positively fixed to the segment 106 by a pressed sleeve coupling 110 of sufficient size to avoid passage through the entry 73. It is recognized that the end 105 and segment 106 can be separately secured against movement with respect to the body member 71 by various means. As illustrated by FIG. 2, the pressed sleeve 110 is retained within a recess 111 (FIG. 3) which forms a part of the first cable passageway 72.

Figure 10:
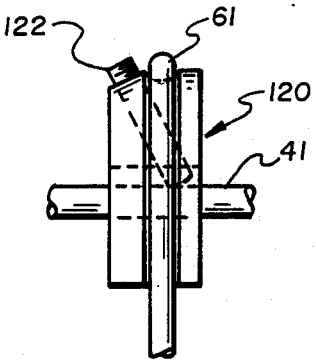
Figure 14:
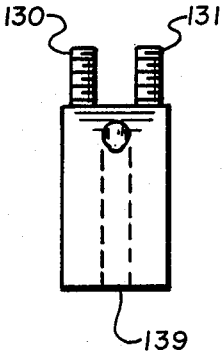
Figure 18:
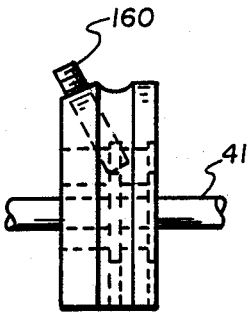
Figure 11:
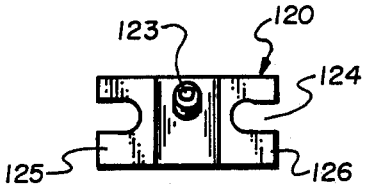
Figure 15:
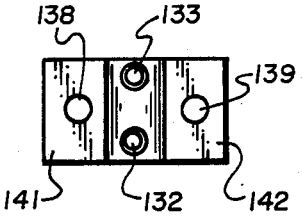
Figure 19:
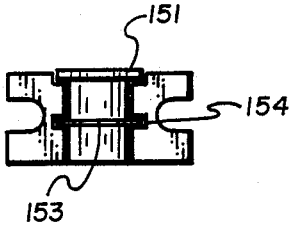
Figure 12:
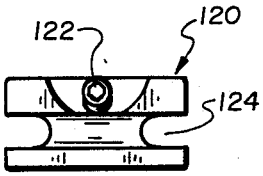
Figure 16:
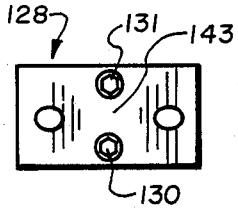
Figure 20:
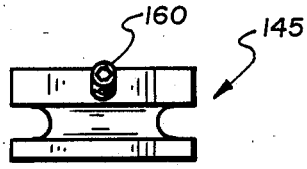
Figure 21:
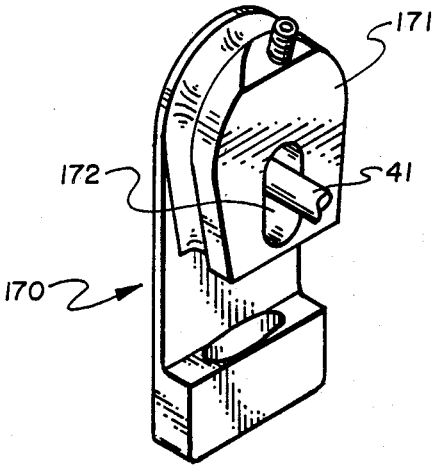
FIG. 21 is a view in perspective of another alternative embodiment of the invention.
Figure 22:
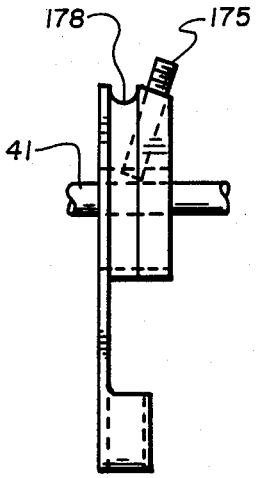
FIG. 22 is a view similar to FIG. 21 rotated approximately 90 about a vertical axis as compared to FIG. 21.
Figure 23:
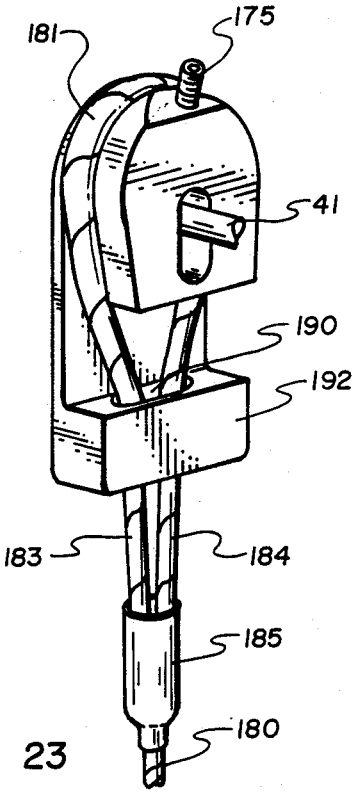
FIG. 23 is a view of the embodiment of FIGS. 21 and 22 in assembled conduit, on in association with a tension cable.
Figure 24:
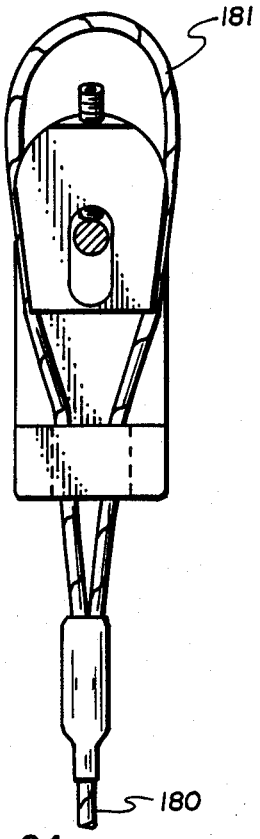
FIG. 24 is a view similar to FIG. 23 showing the tension cable in partially assembled condition.

The traveling members 80, 81 illustrated by FIGS. 2, 3, 4, 6 and 8 are intended to be contacted by the part 108 of the intermediate segment 104 connecting the loops 61 and 62. FIGS. 9 through 12 illustrate an alternative embodiment in which a traveling member, designated generally 120, is directly associated with the axle 41 rather than a body member 71. Such traveling members (e.g. 120) may be used to either replace or supplement traveling members (e.g. 80, 81) associated with assemblies (e.g. 70) of the type illustrated by FIG. 3. A body member 71, either with or without an associated traveling member is suitable for use with any of the traveling members illustrated by FIGS. 9, 13 or 17. An adjusting screw 122 is turned either clockwise or counterclockwise, as appropriate, to advance or withdraw its distal end 1123 with respect to the axle 41. The loop 61 (and/or 62) is received by a peripheral groove 124, and a pair of legs 125, 126 straddle the axle 41. The screw 122 is canted, as best shown by FIG. 10, to avoid contact by the loop 61.

The embodiment, designated generally 128, illustrated by FIGS. 13 through 16 is similar in function and operation to that illustrated by FIGS. 9 through 12. A pair of bolts 130, 131 present distal ends 132, 133 (FIG. 15) in direct vertical contact with the axle 41. A cable path is provided by channels 138, 139 through legs 141, 142, and across a region 143 between the bolts 130, 131.

The alternative embodiment, designated generally 145, illustrated by FIGS. 17 through 20 is also similar but incorporates a bushing 150 with a flange 151 traveling on a recessed channel 152 and an annular retaining ring 153 traveling in an internal slot 154. The axle 41 is journaled through the bushing 150, and the adjusting bolt 160 bears on the bushing, rather than directly on the axle 41.

Each of the traveling members 80, 81, 120, 128 and 145 illustrated functions to adjust the effective length of the cable 60. This adjustment can be done during any stage of draw because all that is required is to turn an adjusting bolt either clockwise or counterclockwise. Whether the adjustment is made at the axle(FIGS. 9 through 20) or at the body member 71, the effect is to change the length of cable 60 required to traverse the path illustrated by FIGS. 1 and 2 with the axles 41, 46 and eccentric members 40, 45 remaining in a fixed position. As a consequence, the axles and/or eccentrics must move in response to any adjustment of the position of a traveling member. A particular benefit offered by this invention is the capability of "timing" the eccentric members at full draw. At the same time, all of the benefits of the yoke systems in previous use are retained. In particular, the forces applied by a tension cable are equalized to both sides of an eccentric member. This equalization is achieved by means of slippage of the loops 61, 62 around the axle 41 and slippage of the part 108 of the intermediate segment 104 through the cable passageway 75.

FIGS. 21 through 24 illustrate a modified cable anchoring system which preserves the length adjusting feature of the invention in applications in which the equalization of rorces analogous to yoke systems is not of major concern. An adjustable axle spacer, designated generally 170, includes a body member 171 with an axle slot 172 adapted for receiving an axle 41. An adjusting bolt 175 is turned into the body 171 at an angle to avoid interference with a peripheral cable groove 178. Adjustment of the effective length of the cable 180 is accomplished as previously described by turning the bolt 175 to relocate the loop 181 with respect to the axle. The entire boy member 171 then constitutes a traveling member. The loop 181 is formed by fixing the end strand 183 to an initial segment 184 by means of a pressed sleeve 185. The strands 83, 184 are received and retained by a cable passageway 190 through a retaining boss 192 carried by the body member 171.

The assembly (axle spacer) 170 illustrated by FIGS. 21 through 26 also represents an especially preferred embodiment of the class represented by the various axle-mounted traveling members 120, 128 and 145 illustrated by FIGS. 9 through 20. An assembly 170 may receive either of the loops 61, 62, with the part 108 (FIG. 5) of the intermediate segment 104 passing through an assembly (e.g. 70, FIG. 6). The other loop 61, 62 may pass directly over the axle 41 as shown in FIG. 2, or each loop 61, 62 may be received by an individual assembly 170. In any event, the assembly 70 may, but need not, include cable retaining means (e.g. 96, FIG. 4). Ordinarily, a traveling member (e.g. 80, 81) would be redundant, and need not be included.

Reference herein to the details of the illustrated embodiments is not intended to limit the scope of the appended claims which themselves recite those features regarded as important to the invention.

I claim:

1. In a compound bow of the type in which a cable is attached to a first eccentric member mounted on a first axle carried by a first limb tip, a first portion of said cable extending from said first eccentric for attachment to a bowstring, and a second portion of said cable extending from said first eccentric member for connection to a second axle mounting a second eccentric member to a second limb tip, the improvement which comprises:

a body member defining a first cable passageway with an energy and a second cable passageway intersecting said first passageway with first and second openings remote from said entry;

a traveling member operably associated with said body member and mounted in movable relationship with respect to said second axle;

adjustment means operably associated with said traveling member for selectively changing the position of said traveling member with respect to said second axle;

said second portion of said cable having an initial segment, an intermediate segment, and a terminal end and being configured and arranged with respect to said body member, second axle, second eccentric member and said traveling member as though said terminal end had been run through said entry into said first passageway, thence out said first opening, over said second axle on one side of said second eccentric member, thereby to form a fist loop, back through said first opening through said second cable passageway out said second opening, over said second axle on the other side of said second eccentric, thereby to form second loop and thence back through said second opening;

said terminal end and said initial segment being secured against movement with respect to said body member; and said intermediate segment being positioned for contact by said traveling member opposite said second axle.

2. An improvement according to claim 1, wherein said traveling member is slidably mounted with respect to said body member and a part of said intermediate segment is positioned through said second cable passageway between said raveling member and said entry.

3. An improvement according to claim 1 wherein said traveling member is associated with said second axle and a part of said intermediate segment is positioned in contact with said traveling member opposite said second axle.

4. An improvement according to claim 1 further including cable retaining means associated which said body member whereby said second portion of said cable is held in close association with a second cable attached to said first axle.

5. An improvement according to claim 4, wherein said traveling member is slidably mounted with respect to said body member and a part of said intermediate segment is positioned through said second cable passageway between said traveling member and said entry.

6. An improvement according to claim 4 wherein said traveling member is associated with said second axle and a part of said intermediate segment is positioned in contact with said traveling member opposite said second axle.

7. An improvement according to claim 4 wherein said cable retaining means is integral with said body member.

8. An improvement according to claim 7, wherein said traveling member is slidably mounted with respect to said body member and a part of said intermediate segment is positioned through said second cable passageway between said traveling member and said entry.

9. An improvement according to claim 7 wherein said traveling member is associated with said second axle and a part of said intermediate segment is positioned in contact with said traveling member opposite said second axle.

10. An improvement according to claim 1 wherein said adjustment means is integral with said body member.

11. An improvement according to claim 10, wherein said traveling member is slidably mounted with respect to said body member and a part of said intermediate segment is positioned through said second cable passageway between said traveling member and said entry.

12. An improvement according to claim 11 further including cable retaining means associated with said body member whereby said second portion of said cable is held in close association with a second cable attached to said first axle.

13. An improvement according to claim 1 wherein said adjustment means is integral with said traveling member.

14. An improvement according to claim 13 wherein said traveling member is associated with said second axle and a part of said intermediate segment is positioned in contact with said traveling member opposite said second axle.

15. An improvement according to claim 14 further including cable retaining means associated with said body member whereby said second portion of said cable is held in close association with a second cable attached to said first axle.

16. In a compound bow of the type in which a cable is attached to a first eccentric member mounted on a first axle carried by a first limb tip, a first portion of said cable extending from said first eccentric for attachment to a bowstring, and a second portion of said cable extending from said first eccentric member for connection to a second axle mounting a second eccentric member to a second limb tip, the improvement which comprises:

a body member defining a first cable passageway with an entry and a second cable passageway intersecting said first passageway with first and second openings remote from said entry;

a traveling member mounted in movable relationship with respect to said second axle and slidable within said body member;

adjustment means operably associated with said traveling member and integral within said body member for selectively changing the position of said traveling member with respect to said second axle;

said second portion of said cable having an initial segment, an intermediate segment, and a terminal end and being configured and arranged with respect to said body member, second axle, second eccentric member and said traveling member as though said terminal end had been run through said entry into said first passageway, thence out said first opening, over said second axle on one side of said second eccentric member, thereby to form a first loop, back through said first opening through said second cable passageway between said traveling member and said entry out said second opening, over said second axle on the other side of said second eccentric, thereby to form a second loop and thence back through said second opening;

said terminal end and said initial segment being secured against movement with respect to said body member.

17. An improvement according to claim 16 further including cable retaining means associated with said body member whereby said second portion of said cable is held in close association with a second cable attached to said first axle.

18. An improvement according to claim 17 wherein said cable retaining means is integral with said body member.

19. In a compound bow of the type in which a cable is attached to a first eccentric member mounted on a first axle carried by a first limb tip, a first portion of said cable extending from said first eccentric for attachment to a bowstring, and a second portion of said cable extending from said first eccentric member for connection to a second axle mounting a second eccentric member to a second limb tip, the improvement which comprises:

a body member defining a cable passageway with an entry;

a traveling member operably associated with said body member and mounted upon and in movable relationship with respect to said second axle;

adjustment means operably associated with said traveling member for selectively changing the position of said traveling member with respect to said second axle;

said second portion of said cable extending through said entry and passageway, and terminating in a loop positioned around said second axle in contact with said traveling member.

20. An improvement according to claim 19 wherein said adjustment means is integral with said raveling member and said traveling member is mounted on said axle and integral with said body member.

21. An improvement according to claim 19 wherein said adjustment means is integral with said traveling member.

22. An improvement according to claim 21 wherein said body member is separate from said traveling member.

23. An improvement according to claim 22 wherein said second portion of said cable has an initial segment, an intermediate segment, and a terminal end and is configured and arranged with respect to said body member, second axle, second accentric member and said traveling member as through said terminal end has been run through said entry and cable passageway, over said second axle on one side of said second accentric member, thereby to form a first loop, back through said cable passageway and over said second axle on the other side of said second accentric, thereby to form a second loop and thence back through said passageway and out said entry, one of said first and second loops being the loop positioned in contact with said traveling member.

* * * * *

UNITED STATES PATENT OFFICE

CERTIFICATE OF CORRECTION

Patent No. 4,909,231 Dated March 20, 1990

Inventor(s) Marlow W. Larson

It is certified that error appears in the above-identified patent and that said Letters Patent is hereby corrected as shown below:

Col. 6:
Claim 1, line 40, delete "energy" and add --entry--.
Col. 7:
Claim 2, line 5, delete "raveling" and add --traveling--.

Signed and Sealed this

Third Day of December, 1991

*Attest:*

HARRY F. MANBECK, JR.

*Attesting Officer*

*Commissioner of Patents and Trademarks*